United States Patent [19]

Warrick et al.

[11] 4,246,826

[45] Jan. 27, 1981

[54] DRUMSTICK

[76] Inventors: David Warrick, 16020 Highland Dr., San Jose, Calif. 95127; Tony Fulgar, 5679 Calmor Ave., San Jose, Calif. 95123

[21] Appl. No.: 69,747

[22] Filed: Aug. 27, 1979

[51] Int. Cl.[3] ..... G10D 13/02

[52] U.S. Cl. ..... 84/422 S

[58] Field of Search ..... 84/422 R, 422 S

[56] References Cited

U.S. PATENT DOCUMENTS 1,739,275 12/1929 Zipperstein ..... 84/422 S 3,688,013 8/1972 Menard ..... 84/422 S

FOREIGN PATENT DOCUMENTS 26780 1/1964 German Democratic Rep. ... 84/422 S 107177 6/1917 United Kingdom ..... 84/404

*Primary Examiner*—Lawrence R. Franklin

*Attorney, Agent, or Firm*—Jack M. Wiseman

[57] ABSTRACT

A drumstick for use with a musical percussion instrument comprises a wooden body portion having a flexible rod projecting from one end. A nylon sleeve is disposed adjacent the junction of the body and the flexible rod to protect and strengthen the body at this point.

7 Claims, 3 Drawing Figures

DRUMSTICK

BACKGROUND OF THE INVENTION

The present invention relates to a drumstick of the type commonly employed in playing percussion instruments such as drums, cymbals and the like.

Drumsticks are usually made of wood because suitable woods are readily available, relatively inexpensive, and easily worked. Further, wooden drumsticks have good handling and acceptable rebound characteristics. However, wooden drumsticks may splinter, chip, crack or break after a relatively short period of normal use. In an effort to overcome the undesirable properties of wooden drumsticks while retaining their desirable characteristics, various non-wood combinations have been proposed for the fabrication of drumsticks. Reference may be had to the U.S. Pat. No. 3,958,485 to Peters and the U.S. Pat. No. 4,040,323 to Kline for disclosures of drumsticks constructed of fiberglass or thermoplastic materials such as nylon. The U.S. Pat. No. 3,722,350 to Cordes discloses a drumstick made of a generally tubular metal member partially covered by a plastic coating or sleeve. The U.S. Pat. to Robba et al., No. 3,146,659, and that to Colyer et al., U.S. Pat. No. 3,489,052, disclose the combined use of metal and plastic for providing a drumstick with desired characteristics. Further, U.S. Pat. No. 3,688,013, to Menard and that to Fiedler et al., U.S. Pat. No. 4,047,460, disclose constructions which incorporate nylon and rubber in a drumstick. Although the disclosures of the above patents presumably provide drumsticks that are free of several of the more common undesirable defects, it is evident that the disclosed methods and constructions differ greatly from the manner in which an improved drumstick is produced according to the present invention, and to the present novel drumstick itself.

SUMMARY OF THE INVENTION

The drumstick according to the present invention is comprised of a body portion made of wood, such as hickory, having the configuration and weight distribution of the corresponding portion of a standard jazz side drumstick. The forward tapered end of the body is drilled axially, and a flexible fiberglass rod is secured in the opening with a portion extending outwardly away from the end of the body to receive a nylon tip at the distal end. A sleeve of tough, strong material, such as nylon, is disposed over the lower end of the tapered portion of the body to protect this portion from damage due to impact with the rim of the drum and to provide added resistance to the splintering, chipping and cracking of this section of the drumstick.

Accordingly, it is an object of the present invention to provide a drumstick having improved characteristics as to durability and having superior resilient rebound characteristics that are substantially constant over the life of the drumstick.

DESCRIPTION OF THE PREFERRED EMBODIMENT

Figure 1:
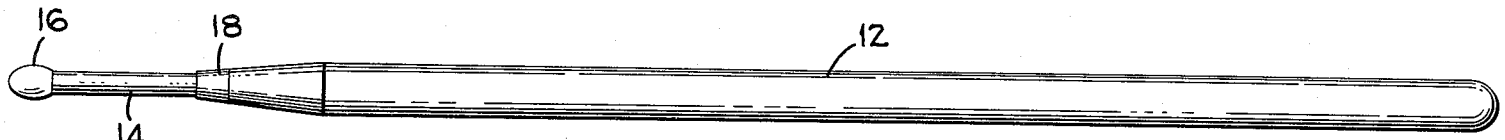
FIG. 1 is a side elevation of the drumstick of the present invention.

In FIG. 1, the drumstick of the present invention is illustrated as comprising a body portion 12, a flexible rod 14 projecting forwardly from the body 12, a nylon tip 16 and a protecting and reinforcing band or sleeve 18 at the juncture of the body 12 and the flex rod 14.

Figure 2:
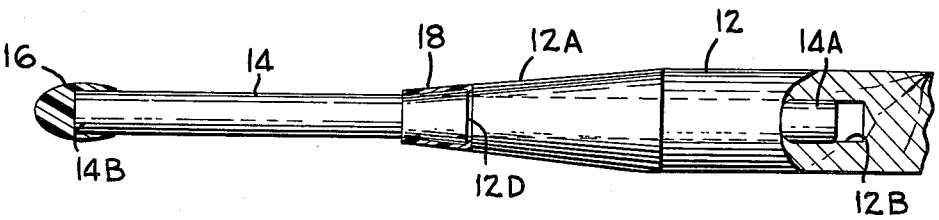
FIG. 2 is an enlarged fragmentary view of the drumstick of FIG. 1, which parts shown in section.

The drumstick body 12 is a generally cylindrical member made of wood, such as hickory, and provided with a tapered forward section 12A (FIG. 2). A cylindrical opening 12B, drilled axially in the forward end portion of the body 10, receives the rearward end 14A of the flex rod 14. The rod end portion 14A, which may extend substantially to the base of the opening 12B, is secured in the opening by an epoxy glue.

The flex rod 14 is a fiberglass rod, made of glass fibers embedded in epoxy, and is of cylindrical configuration approximately $\frac{1}{4}$ inch in diameter.

The nylon tip 16 is secured to a reduced diameter portion 14B of the flex rod by means of a suitable binder, such as a commercial glue or by a press fit.

Figure 3:
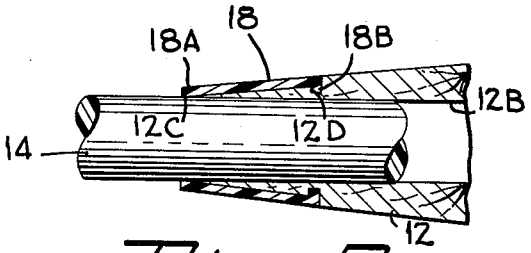
FIG. 3 is an enlarged sectional view of a portion of FIG. 2.

The protecting and reinforcing sleeve 18 is made of nylon and is generally frusto-conical in exterior configuration. The forward end portion 18A (FIG. 3) of the sleeve overlies the forwardmost end portion 12C of the body 12 and protects this relatively thin section from possible damage due to impacts of this section of the drumstick with the metal rim of the drum. At its rearward end, the sleeve 18 is provided with an inturned flange 18B adapted to be snapped into an annular groove 12D formed in the tapered section 12A of the body 12 at a point spaced rearwardly from its forward edge. The engagement of the flange 18B in the body 12 retains the sleeve 18 in its position protecting the forward end portion of the body. The nylon sleeve is of generally uniform thickness along its length and it not only protects the end of the body 12 from impact damage but also is of a thickness and stiffness to strengthen and rigidify this tapered end portion of the body.

The wooden body 10 of the drumstick of the present invention has the configuration and weight distribution of the corresponding portion of a jazz-sized wooden drumstick, and may have a length (FIG. 1) of approximately 14 inches. The combined length of the operating portion of the flex rod and the tip is approximately two inches. The length of the sleeve 18 is approximately $1\frac{1}{8}$ inches. With the above described configuration and design, a drumstick produced according to the present invention will be relatively free from damage due to impacts on the metal rim of the drum. The flex rod provides a superior resilient rebound from the head of the drum or other percussion instrument with which it is used. It will also be evident from the above description that the drumstick is relatively simple in construction and easily assembled. While the dimensions noted above provide an effective, improved drumstick, it will be understood that they may be varied somewhat without departing from the principles of the present invention, particularly from the concepts embodied in the advantageous arrangement of a flexible fiberglass rod projecting forwardly from a wooden body of a drumstick to provide superior rebound characteristics which will be substantially unaffected by moisture and the like, and the provision of a protecting and strengthening sleeve or band over the reduced section of the body adjacent the point where the flexible rod enters the body. While the sleeve has been described as being made of nylon, other materials having generally equivalent characteristics of strength, elasticity and toughness may be used.

We claim:

1. A drumstick, comprising a generally cylindrical elongate wooden member having an axially extending opening in one end portion, a flexible fiberglass rod secured in said opening and having a flexing portion projecting outwardly from said wooden member, and a drum contact tip secured to the end of said flexing portion.

2. A drumstick according to claim 1 wherein said rod is generally cylindrical and approximately $\frac{1}{4}$ inch in diameter.

3. A drumstick comprising a body of generally cylindrical configuration having an end portion of generally frusto-conical configuration, a flexible rod secured to said body and projecting axially away from one end of said body, drum contact means at the free end of said rod, and a sleeve of generally frusto-conical exterior configuration disposed over said body adjacent said one end and extending in protecting relation over said body for a predetermined distance away from said one end.

4. A drumstick according to claim 3 wherein the end portion of said body is provided with an axially-extending opening and said flexible rod is secured in said opening along the axis of said body and projects outwardly therefrom.

5. A drumstick according to claim 4 wherein the axial opening and the frusto-conical end portion of said body define a wall portion of reduced thickness on said end portion, said sleeve being made of a material having the toughness and elasticity characteristics of nylon for protecting and strengthening said wall portion.

6. A drumstick according to claim 3 wherein said body is provided with an annular groove extending around the transverse periphery of said body at a point adjacent said one end, and said sleeve has an inturned annular flange disposed in said groove to retain said sleeve on said body.

7. A drumstick according to claim 6 wherein said sleeve is made of nylon.

* * * * *